US005398630A

United States Patent [19]

Skaarup et al.

[11] Patent Number: 5,398,630

[45] Date of Patent: Mar. 21, 1995

[54] SIMPLIFIED MIDBODY SECTION FOR MARINE VESSELS AND METHOD AND APPARATUS FOR CONSTRUCTION

[75] Inventors: Ole Skaarup, Greenwich; James H. Hara, Ridgefield, both of Conn.

[73] Assignee: US Shipbuilding Corporation, Inc., Greenwich, Conn.

[21] Appl. No.: 125,769

[22] Filed: Sep. 24, 1993

Related U.S. Application Data

[63] Continuation-in-part of Ser. No. 974,159, Nov. 10, 1992, abandoned.

[51] Int. Cl.[6] ..... B63B 25/08

[52] U.S. Cl. ..... 114/74 A

[58] Field of Search ..... 114/65 R, 65 A, 72, 114/73, 74 R, 74 A, 78; 220/901; 29/428, 429

[56] References Cited

U.S. PATENT DOCUMENTS

| | | | |
|---|---|---|---|
| 1,167,503 | 1/1916 | Jones | 114/78 |
| 3,437,068 | 4/1969 | Erlbacher | 114/65 A |
| 3,719,302 | 3/1973 | Hamilton | 114/74 A |
| 3,871,319 | 3/1975 | Turner | 114/65 A |
| 3,941,272 | 3/1976 | McLaughlin | 114/74 A |
| 3,978,808 | 9/1976 | Cuneo et al. | 114/74 A |

OTHER PUBLICATIONS

"Strength Evaluation of Novel Unidirectional-Girder System Product Oil Carrier by Reliability Analysis," Soc. Nav. Archs. and Marine Engs., 1985.

"Structural 'Design-by-Analysis Approach Applied to a Product Oil Carrier with a Uni-Directional Girder System," Royal Inst. of Naval Archs., 1990.

"Epoch Mark II New Generation Product Oil Carrier", Hitachi Zosen Corporation, Maizuru Japan, 1990.

*Primary Examiner*—Stephen P. Avila

*Attorney, Agent, or Firm*—John H. Crozier

[57] ABSTRACT

In a preferred embodiment, a midbody section for a midbody section for a marine vessel of the double hull type, said midbody section having joined rectilinear top, bottom, and two side hull portions, said midbody section comprising: said top, bottom, and two side hull portions being constructed from substantially identically dimensioned rectilinear sandwich sections and having inner and outer hull plates, said inner and outer hull plates being joined together by at least longitudinally extending members welded to said inner and outer hull plates. The invention includes method and apparatus for construction of the sandwich sections.

8 Claims, 6 Drawing Sheets

SIMPLIFIED MIDBODY SECTION FOR MARINE VESSELS AND METHOD AND APPARATUS FOR CONSTRUCTION

CROSS-REFERENCE TO RELATED APPLICATION

This application is a continuation-in-part of U.S. application Ser. No. 07/974,159, filed Nov. 10, 1992, now abandoned.

BACKGROUND OF THE INVENTION

1. Field of the Invention

The present invention relates to marine vessels generally and, more particularly, but not by way of limitation, to a marine vessel of novel, simplified design and novel method and apparatus for the construction thereof.

2. Background Art

Marine vessels have been used for years for transporting liquids such as petroleum and the products thereof. Recent regulations have required that vessels for the transportation of petroleum and petroleum products will be of double hull constructions and that single hull vessels will be retired. The theory of such requirement is that double hulls will minimize the discharge of the contents of the vessels in the case of grounding or collision.

Double hull vessels are also of interest in the transport of bulk cargo, such as gypsum or mineral ore, in the transport of roll-on/roll-off cargo, and in container ships. The interest in such cases is not so much with minimizing leaking of the cargo, but, rather, with minimizing the possibility of the vessel sinking or otherwise becoming disabled.

Double hull vessels are constructed of joined sandwich sections with inner and outer hull portions joined and spaced apart by longitudinal and transverse plates disposed between and welded to the inner and outer hulls. In the typical building of such hulls, a hull plate is placed on a horizontal surface and several longitudinal plates are placed vertically on the hull plate and are simultaneously robotically welded to the hull plate. Transverse plates are then joined between the longitudinal plates. A problem with this method of construction is that the simultaneous welding of all the longitudinal plates can distort the hull plate and/or create built-in stresses.

A disadvantage of such conventional double hull construction is that the sandwich sections are non-uniform, with a section for one portion of a midbody being different from a section for another, yet similar, portion of the same midbody. For example, the bottom hull portions typically have a thickness which is greater than the side hull portions which typically have a thickness which is greater than the deck hull portion. This type of construction, together with other features of conventionally constructed double hulls, results in a non-uniform structure having a relatively high degree of complexity of construction, with the concomitant high labor content in the cost of constructing a double hull vessel.

Accordingly, it is a principal object of the present invention to provide a midbody section for a double hull vessel that is simple in design and economically constructed.

It is an additional object of the invention to provide a method and apparatus for the construction of such a double hull vessel.

Other objects of the present invention, as well as particular features, elements, and advantages thereof, will be elucidated in, or be apparent from, the following description and the accompanying drawing figures.

SUMMARY OF THE INVENTION

The present invention achieves the above objects, among others, by providing, in a preferred embodiment, a midbody section for a marine vessel of the double hull type, said midbody section having joined rectilinear top, bottom, and two side hull portions, said midbody section comprising: said top, bottom, and two side hull portions being constructed from substantially identically dimensioned rectilinear sandwich sections and having inner and outer hull plates, said inner and outer hull plates being joined together by at least longitudinally extending members welded to said inner and outer hull plates. In another embodiment of the invention, there is provided a method of fabricating a sandwich section for the construction of such a midbody section, said method comprising: placing a first hull panel on a first horizontal support; placing a plurality of first longitudinal plates vertically on said first hull panel and welding edges of said first longitudinal plates thereto; placing a second hull panel on a second horizontal support; placing a plurality of second longitudinal plates vertically on said second hull panel and welding edges of said second longitudinal plates thereto; rotating said first hull panel 180 degrees and placing said first hull panel over said second hull panel with edges of said first longitudinal plates in contact with said second hull panel and edges of said second longitudinal plates in contact with said first hull panel; welding edges of said first longitudinal plates to said second hull panel; and welding edges of said second longitudinal plates to said first hull panel.

In a further embodiment of the invention, there is provided an apparatus for fabricating such a sandwich section, comprising: a first horizontal support for the placement thereon of a first hull panel; a second horizontal support spaced horizontally from said first horizontal support for the placement thereon of a second hull panel; a fixedly journalled, horizontal, rotatable shaft rotatable about an axis disposed between and parallel to said first and second horizontal support surfaces; a plurality of arms fixedly attached to and extending laterally from said shaft, said arms being adapted for the releasable attachment thereto of said first hull panel; means to rotate said arms with said first panel attached thereto, after welding to said first panel a plurality of first longitudinal plates, so that edges of said first longitudinal plates are in contact with said second panel.

BRIEF DESCRIPTION OF THE DRAWING

Understanding of the present invention and the various aspects thereof will be facilitated by reference to the accompanying drawing figures, submitted for purposes of illustration only and not intended to define the scope of the invention, on which.

DETAILED DESCRIPTION OF THE PREFERRED EMBODIMENTS

Figure 1:
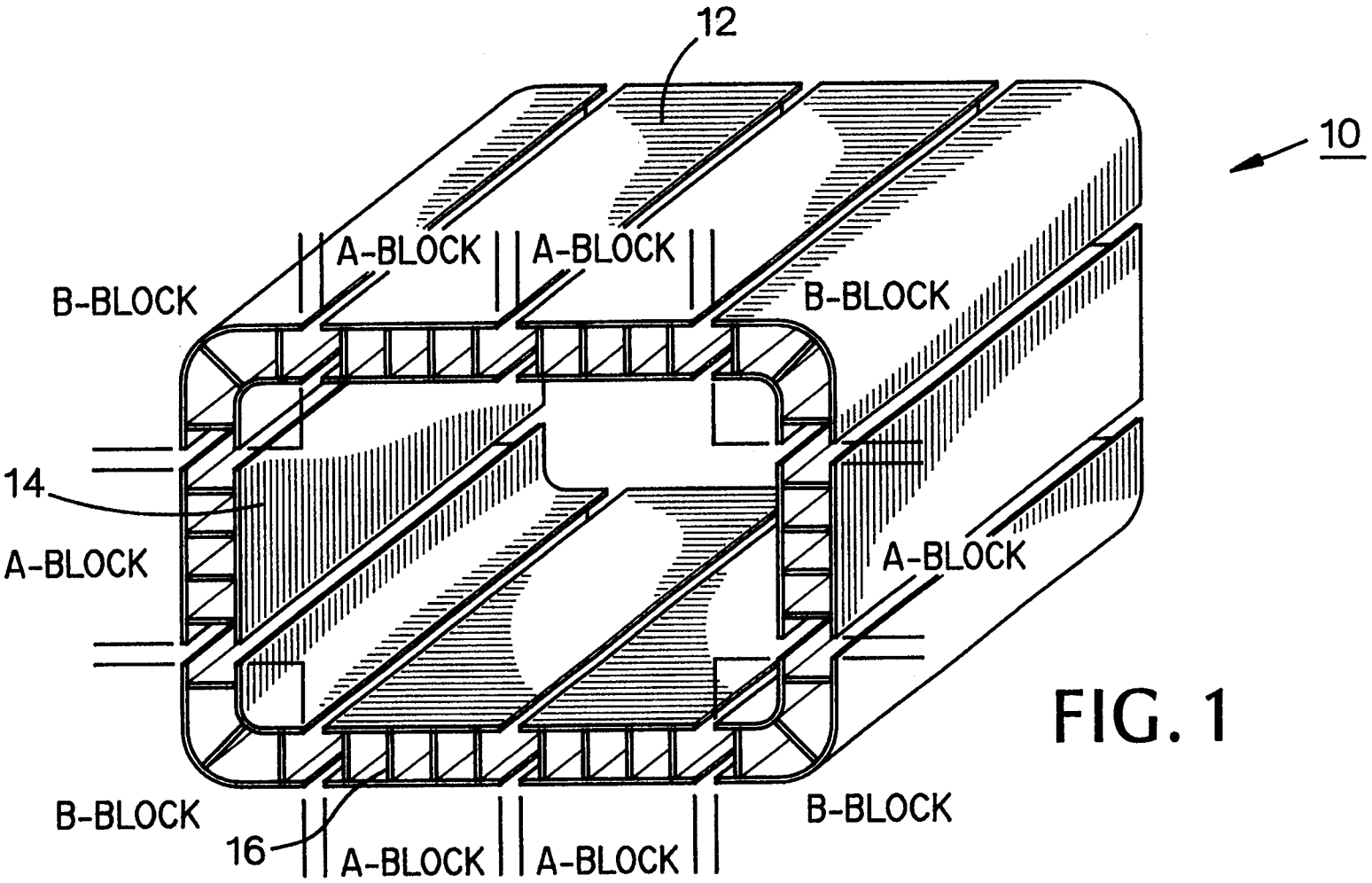
FIG. 1 is an exploded, oblique view of a midbody section for a double hull vessel, constructed according to the present invention.

Reference should now be made to the drawing figures, on which similar or identical elements are given consistent identifying numerals throughout the various figures thereof, and on which parenthetical references to figure numbers direct the reader to the view(s) on which the element(s) being described is (are) best seen, although the element(s) may be seen also on other views.

FIG. 1 illustrates a midbody section for a double hull vessel, generally indicated by the reference numeral 10. Midbody section 10 is generally rectilinear and includes inner and outer hull portions 12 and 14, respectively, spaced apart and joined by longitudinally extending plates, as at 16. The deck, bottom, and side portions of midbody section 10 are constructed of identically dimensioned sandwich sections each designated "A-Block," while the corner sandwich sections are each designated "B-Block." It can be seen that the entire midbody section 10 is constructed of only two types of buildings blocks, A-Block and B-Block. While the overall dimensions of the blocks within one type have the same overall dimensions, the thicknesses of the plates comprising one block may be different from those comprising another block within a type, depending on the final position of the blocks in midbody 10.

Figure 2:
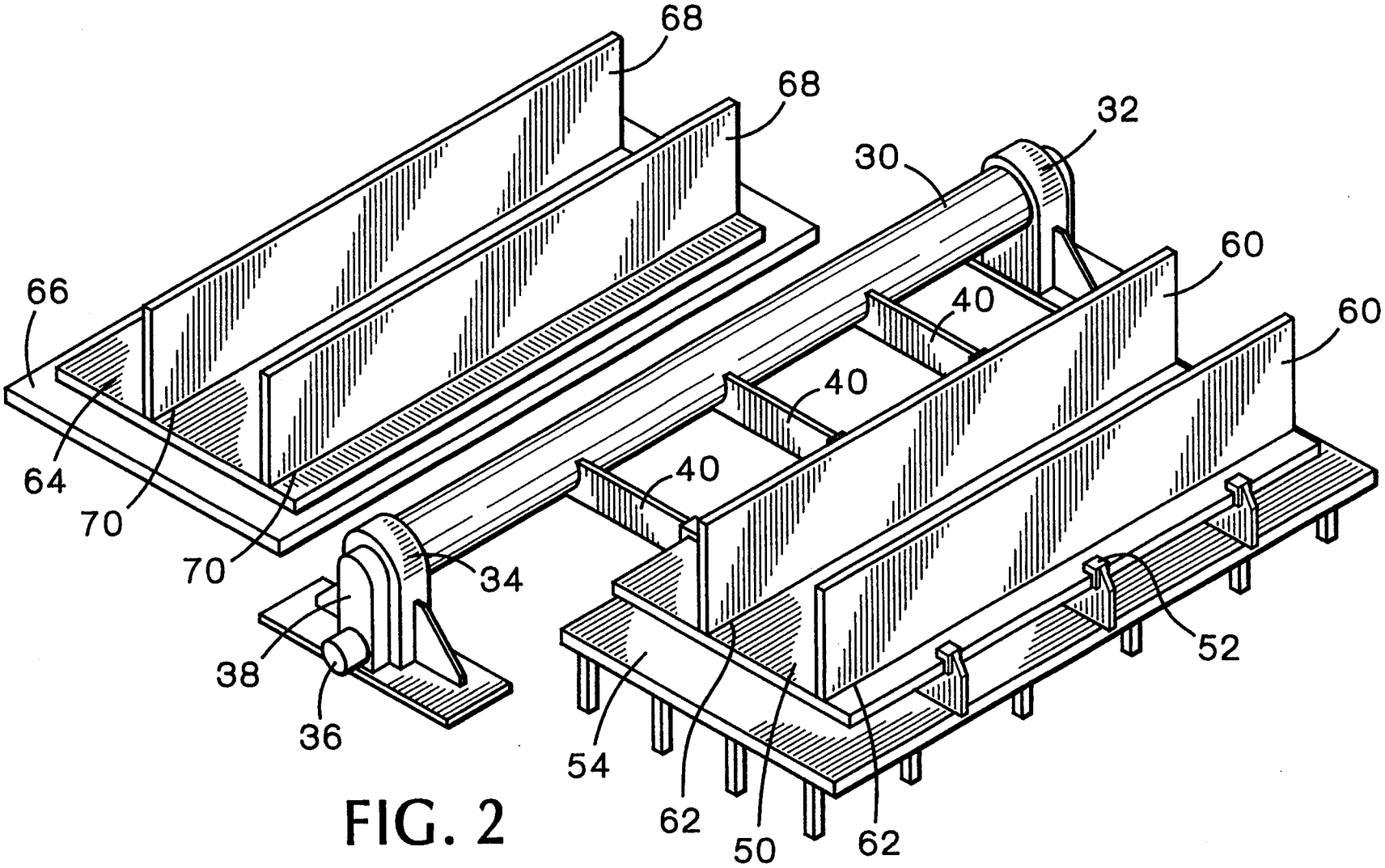
FIG. 2 is an oblique view illustrating the first step in the fabrication of a sandwich section for the midbody section of FIG. 1.

FIG. 2 illustrates the method and apparatus for the construction of an A-Block. The apparatus includes a rotatable shaft 30 journalled in fixed stanchions 32 and 34. Motive power to rotate shaft 30 is provided by an electric motor 36 through a gear box 38. Fixedly attached to shaft 30 are three laterally extending arms 40.

FIG. 2 illustrates the first step in the construction of an A-block. Here, a flat, inner hull panel 50 clamped to arms 40 by means of clamps, as at 52, has been placed horizontally on an upper work surface 54. Then, two longitudinal plates 60 have been vertically placed on inner hull panel 50. Longitudinal plates 60 are now simultaneously robotically welded to inner hull panel 50 at seams 62. Preferably contemporaneously with the foregoing operation, an outer hull panel 64 has been placed horizontally on a lower work surface 66 and, then, two longitudinal plates 68 have been placed thereon and simultaneously robotically welded to the outer hull panel at seams 70.

Figure 3:
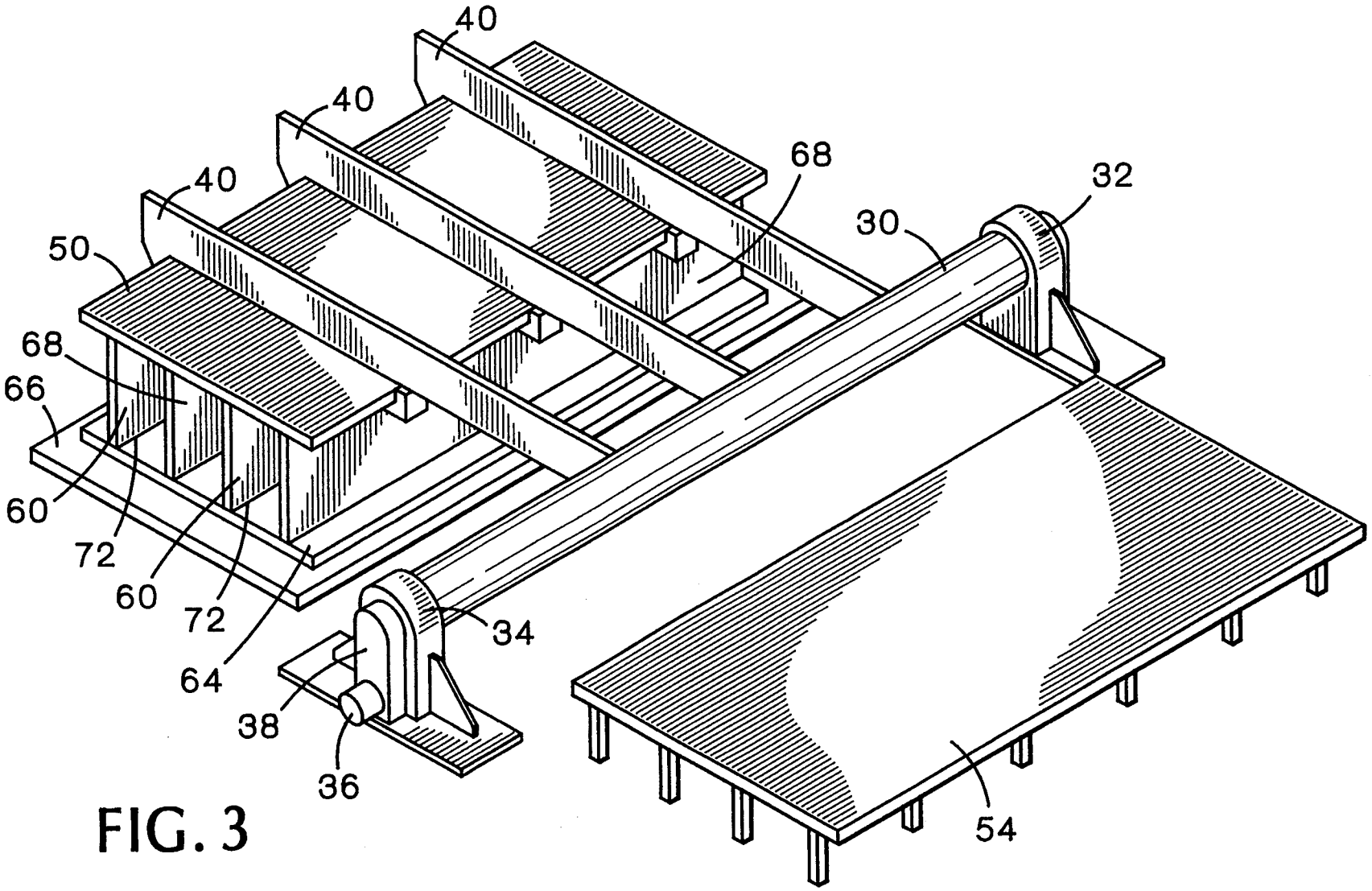
FIG. 3 is a perspective view illustrating the second step in the fabrication of the sandwich section of FIG. 2.

FIG. 3 illustrates the second step in the process of constructing an A-Block. Here, shaft 30 has been rotated 180 degrees so that inner hull panel 50 is horizontally spaced over outer hull panel 64 with the edges of longitudinal plates 60 in engagement with the outer hull panel. Next, longitudinal plates 60 are simultaneously robotically welded to outer hull panel 64 at seams 72. It will be noted that the difference in elevation between upper work surface 54 and lower work surface 66 is the width of plates 60 and 68 less the thicknesses of inner and outer hull panels 50 and 64.

Figure 4:
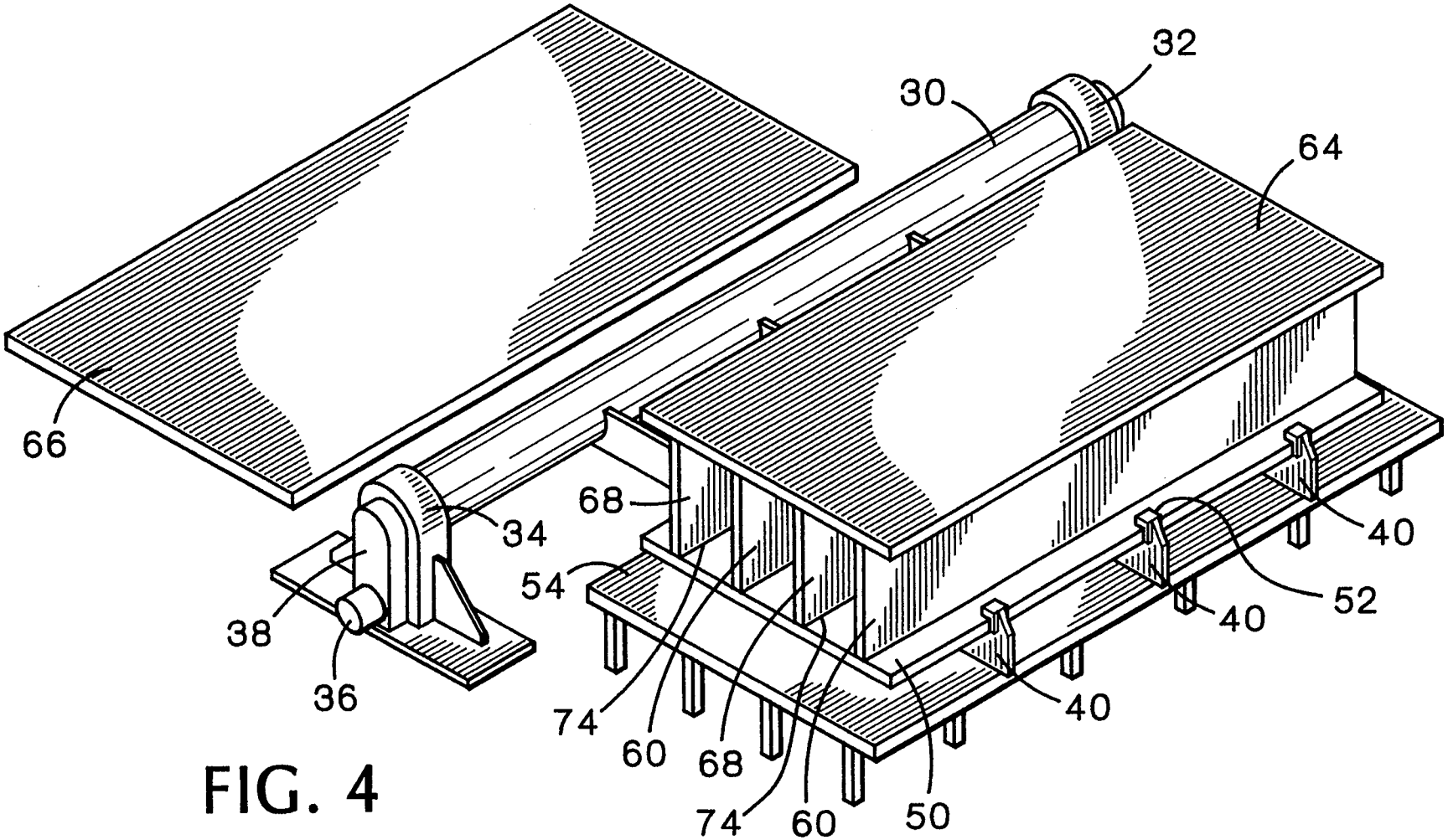
FIG. 4 is a perspective view illustrating the third step in the fabrication of the sandwich section of FIG. 2.

FIG. 4 illustrates the third step in the process of constructing an A-Block. Here, shaft 30 has been rotated 180 degrees so that inner hull panel 50 is again placed horizontally on elevated work surface 54. Because of the second step, above, the entire sandwich structure is now disposed on elevated work structure 54. In this position, longitudinal plates 68 are simultaneously robotically welded to inner hull panel 50 at seams 74.

The A-Block illustrated in FIGS. 2–4 is now complete and can be incorporated into a midbody section 10 (FIG. 1) by suitable fabrication techniques.

The technique described above reduces the tendency for distortion and stress inducement by halving the amount of simultaneous welding that is taking place on the hull plates. The sandwich fabrication technique also lends itself well to fully automated operation.

In a similar manner, identically dimension B-Blocks can be fabricated.

Figure 5:
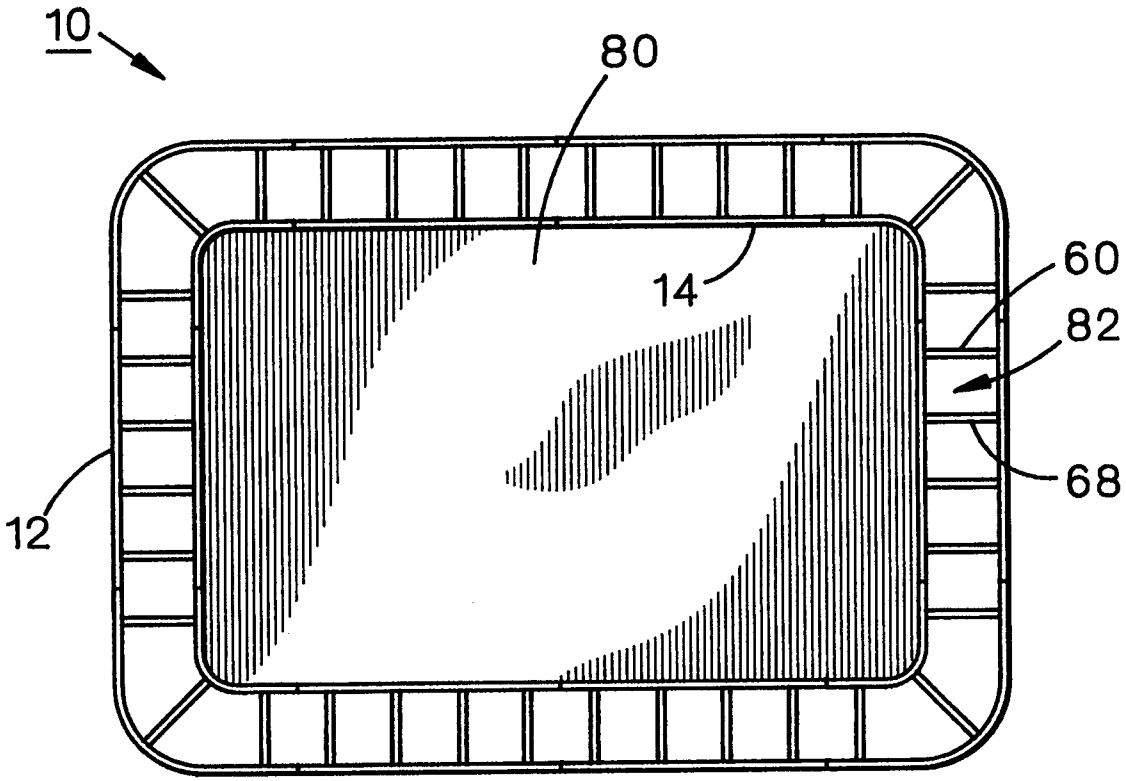
FIG. 5 is a side elevational view of a completed midbody section.

FIG. 5 illustrates a completed midbody section 10. Here, A-Blocks and B-blocks have been welded together and a bulkhead 80 has been welded to inner hull 14. It should be noted that bulkhead 80 is the only transverse structural metal in midbody 10 and, thus, the passages, as at 82, defined between inner hull 14 and outer hull 12 between adjacent longitudinal plates are longitudinally open. Since the midbody sections 10 of a vessel are identical, passages 82 extend the length of the midbody portion of a vessel. This affords convenient access for inspection, painting, and/or repair of the midbody portions. Bulkhead 80 may have to have greater strength than conventional bulkheads and, consequently, may be of corrugated or sandwich type conventional construction.

Figure 6:
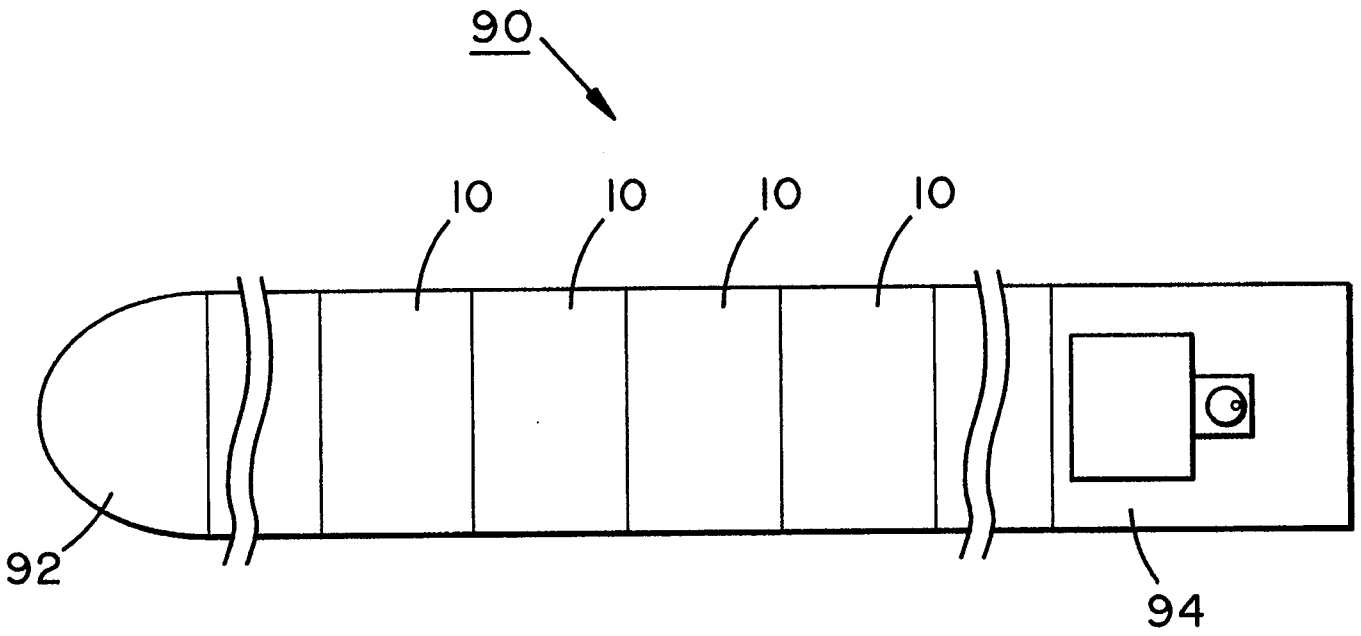
FIG. 6 is a top plan view of a vessel constructed of midbody sections of the type of FIG. 1.

FIG. 6 illustrates a vessel, generally indicated by the reference numeral 90, constructed with midbody sections 10. Vessel 90 comprises a plurality of joined midbody sections 10 to the ends of which have been joined conventional bow and stern sections 92 and 94, respectively.

It will thus be seen that the objects set forth above, among those elucidated in, or made apparent from, the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

We claim:

1. A midbody section for a marine vessel of the double hull type, said midbody section having joined rectilinear top, bottom, and two side hull portions, said midbody section comprising: said top, bottom, and two side hull portions being constructed from identically dimensioned rectilinear sandwich sections and having inner and outer hull plates, said inner and outer hull plates being joined together by at least longitudinally extending members welded to said inner and outer hull plates, said top, bottom, and two side hull portions having ratios of thicknesses thereof on the order of about 1.0:1.0:1.0:1.0.

2. A midbody section, as defined in claim 1, further comprising: four curvilinear hull portions joining said top, bottom,and two side hull portions, said curvilinear hull portions being identically dimensioned and having inner and outer hull plates, said inner and outer hull plates being joined together by at least longitudinally extending members welded to said inner end outer hull plates, said four curvilinear hull portions having ratios of thickesses thereof on the order of about 1.0:1.0:1.0:1.0.

3. A method of fabricating a sandwich section for the construction of a midbody section for a vessel of the double hull type, said method comprising:

(a) placing a first hull panel on a first horizontal support;

(b) placing a plurality of first longitudinal plates vertically on said first hull panel and welding edges of said first longitudinal plates thereto;

(c) placing a second hull panel on a second horizontal support;

(d) placing a plurality of second longitudinal plates vertically on said second hull panel and welding edges of said second longitudinal plates thereto;

(e) rotating said first hull panel 180 degrees and placing said first hull panel over said second hull panel with edges of said first longitudinal plates in contact with said second hull panel and edges of said second longitudinal plates in contact with said first hull panel;

(f) welding edges of said first longitudinal plates to said second hull panel; and (g) welding edges of said second longitudinal plates to said first hull panel.

4. A method, as defined in claim 3, wherein said first horizontal support is spaced horizontally from said second horizontal support and said first horizontal support is elevated above the plane of said second horizontal support and said step of rotating is accomplished by rotating said first hull panel about an axis disposed between said first and second hull panels and parallel thereto.

5. A method, as defined in claim 3, wherein step (g) takes place after rotating said first hull panel to its original position on said first horizontal support.

6. An apparatus for fabricating a sandwich section for the construction of a midbody section for a vessel of the double hull type, said apparatus comprising:

(a) a first horizontal support for the placement thereon of a first hull panel;

(b) a second horizontal support spaced horizontally from said first horizontal support for the placement thereon of a second hull panel;

(c) a fixedly journalled, horizontal, rotatable shaft rotatable about an axis disposed between and parallel to said first and second horizontal support surfaces;

(d) a plurality of arms fixedly attached to and extending laterally from said shaft, said arms being adapted for the releasable attachment thereto of said first hull panel;

(e) means to rotate said arms with said first panel attached thereto, after welding to said first panel a plurality of first longitudinal plates, so that edges of said first longitudinal plates are in contact with said second panel.

7. An apparatus, as defined in claim 6, further comprising means to rotate said first panel to its original position on said first horizontal support after welding edges of said first longitudinal plates to said second hull panel.

8. An apparatus, as defined in claim 6, wherein said first horizontal support surface is elevated above the plane of said second horizontal support surface.

* * * * *